United States Patent [19]

Lemper

[11] Patent Number: 4,660,615

[45] Date of Patent: Apr. 28, 1987

[54] CONTINUOUS CASTING MOLD ASSEMBLY

[75] Inventor: Herbert Lemper, McMurray, Pa.

[73] Assignee: Kabushiki Kaisha Kobe Seiko Sho, Kobe, Japan

[21] Appl. No.: 839,720

[22] Filed: Mar. 14, 1986

[51] Int. Cl.[4] ..... B22D 11/04; B22D 11/124

[52] U.S. Cl. ..... 164/418; 164/443; 164/436

[58] Field of Search ..... 164/418, 443, 436, 459, 164/491, 485

[56] References Cited

U.S. PATENT DOCUMENTS

| | | | |
|---|---|---|---|
| 3,559,720 | 2/1971 | Vogel et al. | 164/418 |
| 3,583,473 | 6/1971 | Strohschein et al. | 164/436 |
| 3,710,845 | 1/1973 | Burkhardt et al. | 164/436 |
| 3,735,801 | 5/1973 | Burkhardt | 164/436 |
| 3,933,192 | 1/1976 | Rodenchuk et al. | 164/459 |
| 4,069,863 | 1/1978 | Hargässner et al. | 164/436 |
| 4,085,793 | 4/1978 | Scheinecker et al. | 164/436 |
| 4,223,717 | 9/1980 | Scheurecker | 164/459 |
| 4,516,622 | 5/1985 | Thöne et al. | 164/436 |
| 4,523,623 | 6/1985 | Holleis et al. | 164/443 |

*Primary Examiner*—Nicholas P. Godici

*Assistant Examiner*—Samuel M. Heinrich

*Attorney, Agent, or Firm*—Oblon, Fisher, Spivak, McClelland & Maier

[57] ABSTRACT

A continuous casting mold assembly that includes a mold unit including a pair of wide mold walls each having a wide copper plate supported on the inner side of a back-up frame and a pair of narrow mold walls each having a narrow copper plate supported on the inner side of a back-up frame and gripped between the wide mold walls; a water supply frame including a datum-side water supply frame adapted to support and determine the position of one of the wide mold walls on the back side thereof, and an adjustable-side water supply frame adapted to support the other wide mold wall for movement in clamping and unclamping directions in parallel relation with the opposing wide mold wall; a clamp mechanism mounted on the part of the water supply frame and operable to clamp the other wide mold wall toward the opposing wide mold wall to grip the narrow mold walls securely therebetween; and a narrow mold wall shift mechanism mounted on the part of the water supply frame to adjust the spacing between the two narrow mold walls.

9 Claims, 12 Drawing Figures

CONTINUOUS CASTING MOLD ASSEMBLY

BACKGROUND OF THE INVENTION

1. Field of the Invention

This invention relates to a mold assembly to be used for continuous casting, and more particularly to a continuous casting mold assembly which facilitates alteration of the width of the casting strip.

2. Background of the Invention

The molds which are used for continuous casting of steel slabs or the like generally have a basic construction which includes a pair of wide back-up frames, each with a wide copper plate fixed thereto, and a pair of narrow back-up frames, each with a narrow copper plate fixed thereto, wherein the narrow back-up frames are gripped securely between the wide back-up frames with the aid of a clamp actuator which is mounted on a clamp frame to retain the wide back-up frames in position.

In continuous casting, there often arises the need for changing the size of the continuously cast strip, especially the width of the continuously cast strip. In order to meet such needs, the molds are generally provided with a shift mechanism which moves the narrow back-up frames along the wide back-up frames when in an unclamped state. For example, shift mechanisms of this sort are known from U.S. Pat. Nos. 4,223,717, 4,516,622 and 4,523,623, which employ narrow frame shift motors mounted on clamp frames to drive screw shafts through a reducer for shifting of the narrow frame positions.

Further, since the wide and narrow copper plates are oscillated and kept in direct contact with the cast strip, such undergo abrasive wear in a short time period, thus necessitating the interuption of the casting operation for replacement of the mold.

For this purpose, it has been the general practice to provide a number of spare molds, each including reducers and screw shafts and drive motors for shifting the narrow mold walls in cooperation with an actuator for the wide frame clamp. These are inseparably mounted on the mold assembly of the conventional construction described above. This has been found to be very uneconomical.

In addition, since the actuator, motors and their adjunct parts have to be disconnected from sources of hydraulic pressure and electric power at the time of mold replacement, the mold assembly requires complicated maintenance procedures, with increased susceptiblities to the occurrence of problems.

SUMMARY OF THE INVENTION

The present invention has as a fundamental object the provision of a continuous casting mold assembly, in which the actuator for clamping the wide mold walls and the shift mechanism for shifting the positions of the narrow mold walls are provided separately from the wide and narrow mold walls.

Namely, it is a fundamental object of the present invention to provide a continuous casting mold assembly in which an actuator and a shift mechanism are separable from a mold unit to permit use of the same actuator and same shift mechanism with a number of spare mold units and which can provide for complete mold replacement simply by changing the wide and narrow mold walls alone.

It is another object of the invention to provide a continuous casting mold assembly which permits replacement of the wide and narrow mold walls easily from above.

It is an additional object of the invention to provide means for facilitating the adjustment of mold width during a casting operation.

It is a further object of the invention to provide a continuous casting mold assembly which is connectible to a water supply in a highly simple manner to receive a supply of cooling water therefrom.

It is still another object of the invention to provided a continuous casting mold assembly which affords simplicity in the maintenance of the drive and water supply systems.

According to the present invention there is provide a continuous casting mold assembly, comprising in combination a mold unit including a pair of wide mold walls each having a wide copper plate supported on a back-up frame, and a pair of narrow mold walls each having a narrow copper plate supported on a back-up frame and opposingly gripped between said wide mold walls; a water supply frame including a datum-side water supply frame adapted to support and determine the position of one of said wide mold walls on the back side thereof, and an adjustable-side water supply frame adapted to support the other wide mold wall for movement between clamping and unclamping positions parallel relative to said one wide mold wall; clamp means mounted on the part of said water supply frame for clamping the other wide mold wall toward said one wide mold wall to grip said narrow mold walls securely therebetween; and a narrow wall shift means mounted on the part of said water supply frame for adjusting the spacing between said narrow mold walls.

With a mold construction according to the present invention, all of the mold wall shift means including the actuator, motors, reducers and screw shafts are provided on the frame means, so that it suffices to change the wide and narrow mold walls for mold replacement, and there is no need to provide shift means for each mold unit. This naturally leads to a substantial reduction in cost.

Since there is no need for disconnecting the actuator and other components from hydraulic pressure sources or electric power sources at the time of mold replacement, maintenance becomes easier.

The advantages of the present invention as compared with the prior art are as follows:

1. Exchangeability of the water jackets only as one cartridge rather than the whole mold assembly.
2. Ability to prealign water jacket cartridge outside of machine on an alignment stand, eliminating the need for in-machine alignment.
3. Automatic water connections between the mold table and the mold frame and the water jackets.
4. Automatic holddown for the water jackets inside the mold frame.
5. Single pass water passages in the mold plates.
6. Width adjustment during casting.
7. Lower manufacturing cost of the mold assemblies.

To eliminate the need for numerous mold frames, the assembly of the present invention has been designed to permit the exchange of the mold water jackets with copper mold plates only, leaving all the costly mold frame structures with width adjustment drives in place to accept the next cartridge of mold water jackets with copper plates.

The two broad face and two narrow face jackets are assembled and clamped to each other outside of the machine. This assembly is then placed into an alignment stand in which the back face radius is aligned with the help of adjusting screws that are part of the back face water jacket. This adjustment places the contact surfaces of the adjustment screws into the exact relative position to the casting radius as the corresponding contact surfaces are in the mold frame. The mold jacket assembly is placed into the mold frame and hydraulic pressure is applied for clamping. The hydraulic clamping force locates the mold back face exactly on the casting radius and completes all water connections. There is no further need to align or even check the mold in the machine.

Hold downs for water jackets inside the mold frame are spring loaded to hold down, and are hydraulically released to manually remove the cotters to permit jacket removal as one assembly.

Mold copper plates with slots are utilized as water passages that are in contact with the water jackets. Water enters the slots at the bottom, travels at high velocity to the top and returns to the water jacket to be returned to the system. Numerous bolts attach the copper mold plates to the water jacket providing proper sealing while permitting mold plate expansion. Several manufacturers throughout the world produce this type of mold plate to order.

Foot rolls are mounted on the mold jackets on both the broad and narrow faces. The narrow face rolls rotate in wound spring outer race type roller bearings while the broad face rolls rotate in self aligning spherical bearings. The rolls are aligned to the mold alignment stand.

The width adjustment during casting is accomplished by four (4) independently driven worm gear jack screws moving the mold narrow faces in or out for width adjustment. Each motor of each jack adjusts the top and bottom of each narrow plate independently and is equipped with a pulse generator to produce proper mold taper depending on adjusting speed, current slab width and casting speed, all sensed and determined by microprocessor.

A simplified structure is thus achieved in the present invention by using a U-shaped main frame which carries a moveable frame. The U-shaped frame contains all water connections to the mold table, width adjustment mechanism, water connections to jackets, backface clamping supports, etc. The moveable frame is equipped with two hydraulic cylinders which provide the clamping force for the mold water jackets. While clamping the water jackets, the following water connections are accomplished as follows:

1. From a U-shaped frame to a moveable frame
2. From a U-shaped frame to an outside radius water jacket
3. From a moveable frame to an inside radius water jacket.

The water connection to the inside radius water jacket is spring loaded and hydraulically retractable to allow easy insertion of the mold jackets into the U-shaped frame. The U-shaped frame also features lead-in guides to facilitate mold jacket insertion into the mold frame.

BRIEF DESCRIPTION OF THE DRAWINGS

The above and other objects, features and advantages of the invention will become apparent from the following description and the appended claims, taken in conjunction with the accompanying drawings which show by way of example a preferred embodiment of the invention and in which:

DESCRIPTION OF THE PREFERRED EMBODIMENTS

Figure 1:
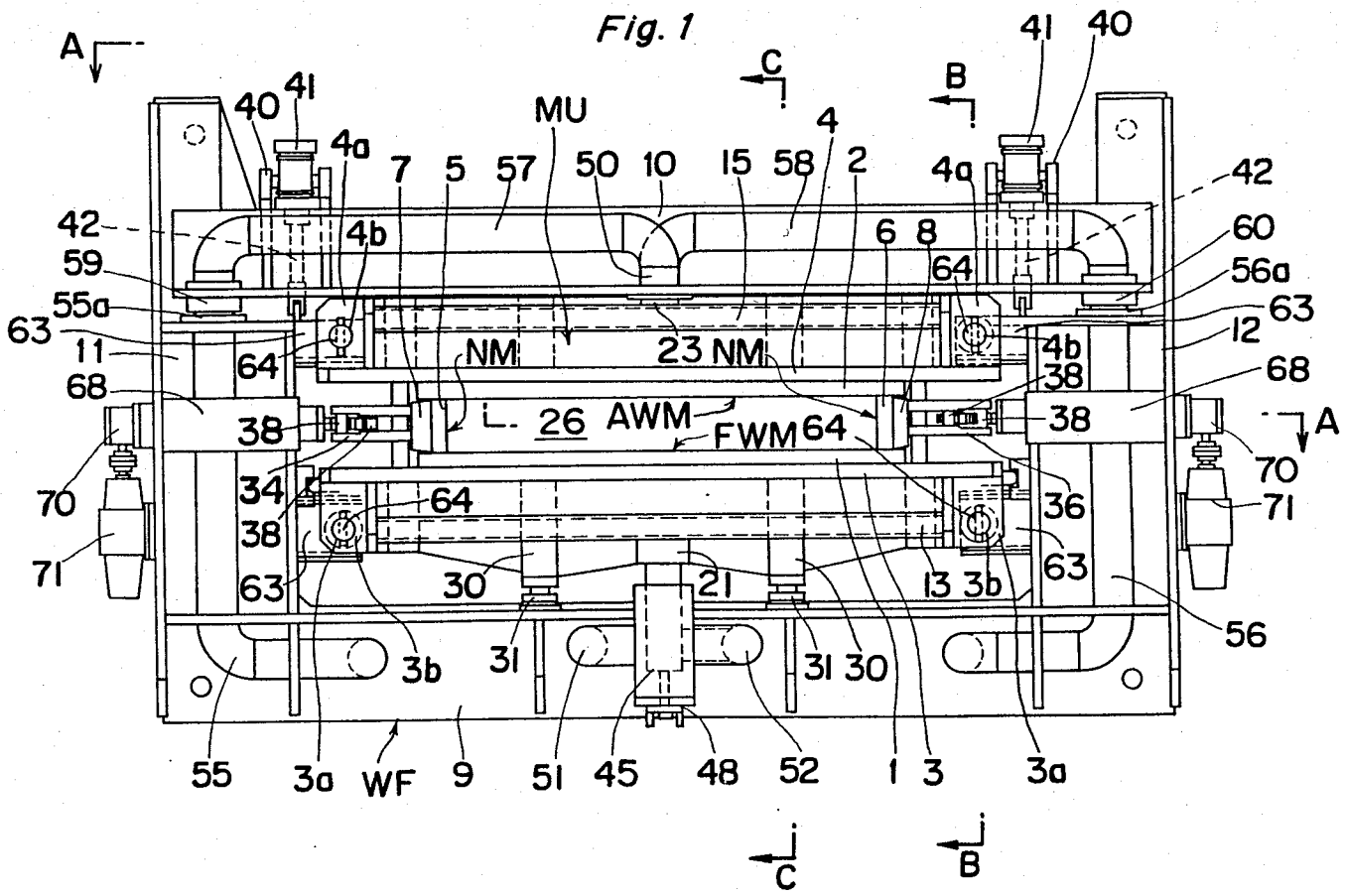
FIG. 1 is a plan view of a continuous casting mold assembly according to the present invention.

Referring to FIGS. 1 to 6, a continuous casting mold assembly according to the invention substantially comprises a mold unit MU and a water supply frame WF. The mold unit MU comprises a combination of a pair of datum-side and adjustable-side wide mold walls FWM and AWM constituted by copper face plates 1 and 2 and a pair of wide back-up frames 3 and 4 which fixedly support the wide copper face plates on the inner wall surfaces thereof, and a pair of narrow mold walls NM constituted by narrow copper face plates 5 and 6 and a pair of narrow back-up frames 7 and 8 which fixedly support the narrow copper face plates on the inner wall surfaces thereof.

The water supply frame WF includes a datum-side water supply frame 9 facing the back side of one wide back-up frame 3, an adjustable-side water supply frame 10 facing the back side of the other wide back-up frame 4, and a pair of support frames 11 and 12 extending horizontally from the opposite ends of the datum-side water supply frame 9 and facing the back sides of the paired narrow back-up frames 7 and 8.

Figure 12:
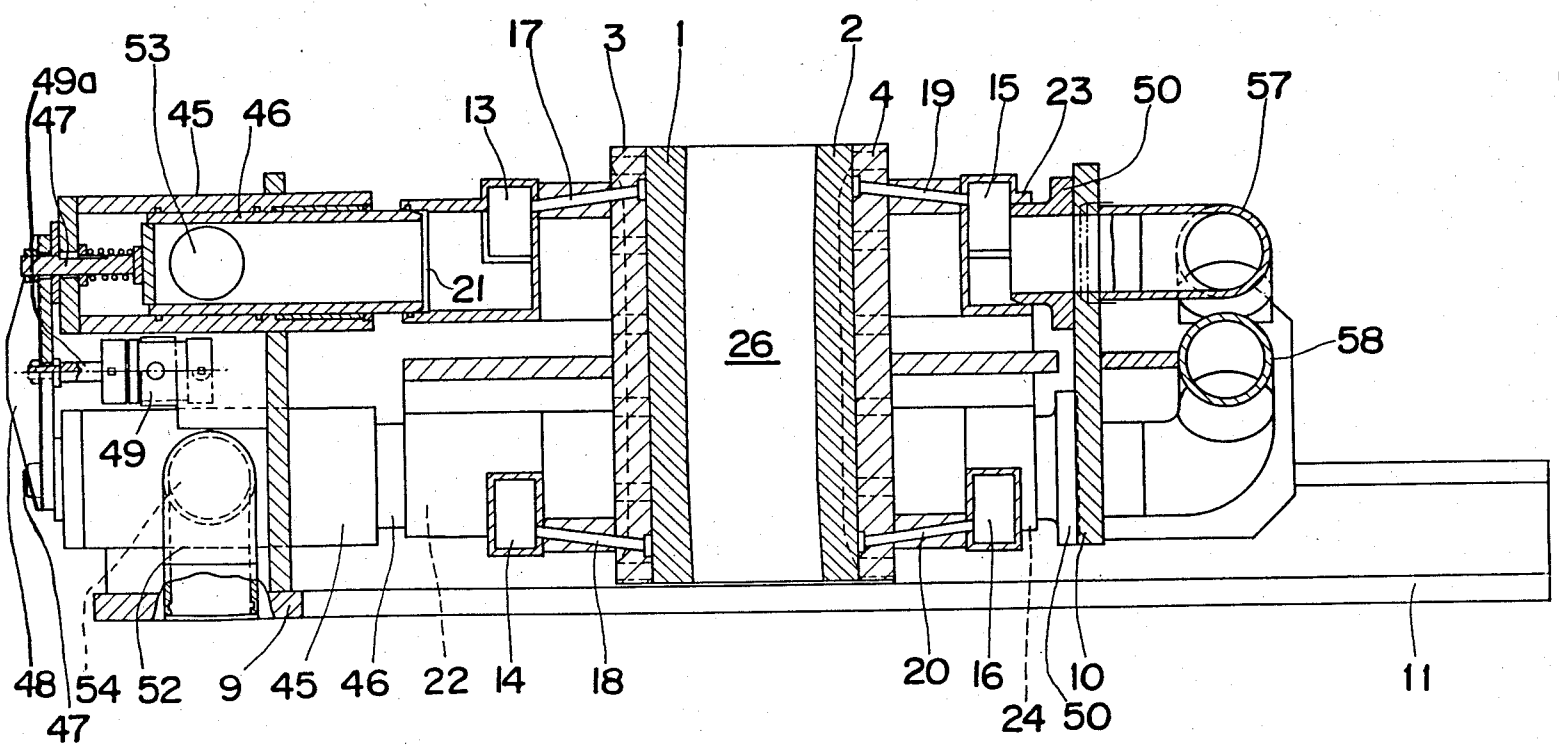
FIG. 12 is an enlarged sectional view taken along line E—E of FIG. 2.

As shown in FIG. 12, upper water ducts 13 and 15 and lower water ducts 14 and 16 are mounted parallelly on the back sides of the wide back-up frames 3 and 4. These water ducts 13 to 16 are communicated with cooling water passages between the wide copper plates 1 and 2 and the wide back-up frames 3 and 4 through intercommunicating passages 17 to 20, respectively. At longitudinally center positions, the upper water duct 13 (15) and the lower water duct 14 (16) are provided with a water feed port 21 (23) and a water discharge port 22 (24), respectively, which are opened toward the opposing water supply frame 9 or 10. Accordingly, there are formed datum-side and adjustable-side water jackets, which include the back-up frames 3, 4 and the associated water ducts.

Figure 4:
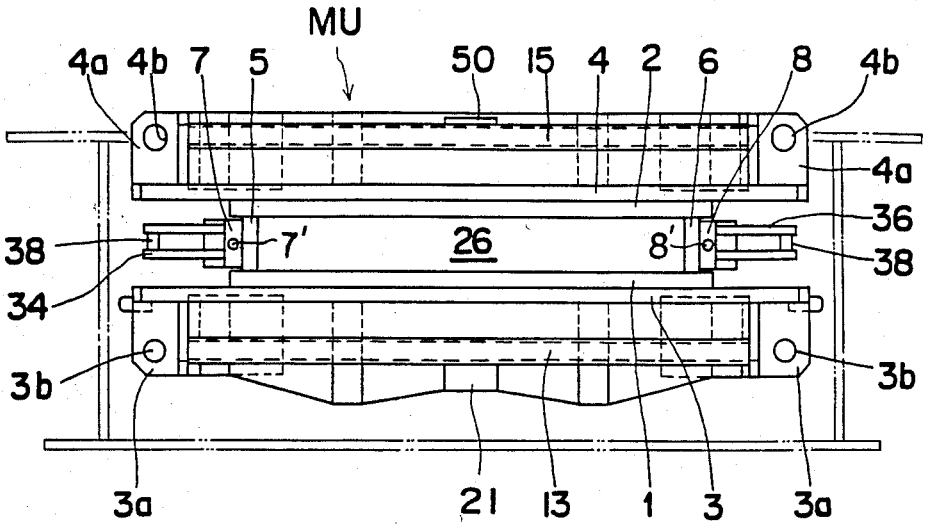
FIG. 4 is a plan view of the mold unit.

Cooling water may be supplied to narrow back-up frames 7, 8 via hoses leading to water inlets 7', 8' (FIG. 4). Therefore, the narrow back-up frames also are water jackets.

Figure 3:
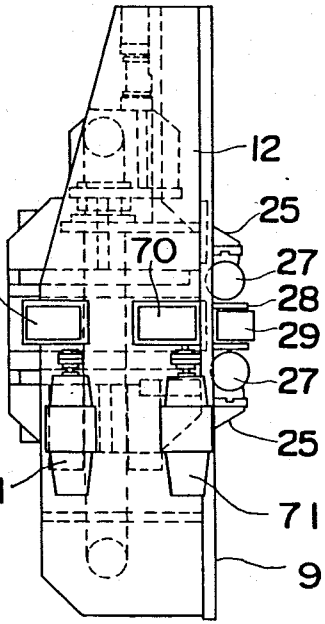
FIG. 3 is a right side view of the mold assembly of FIG. 1.
Figure 2:
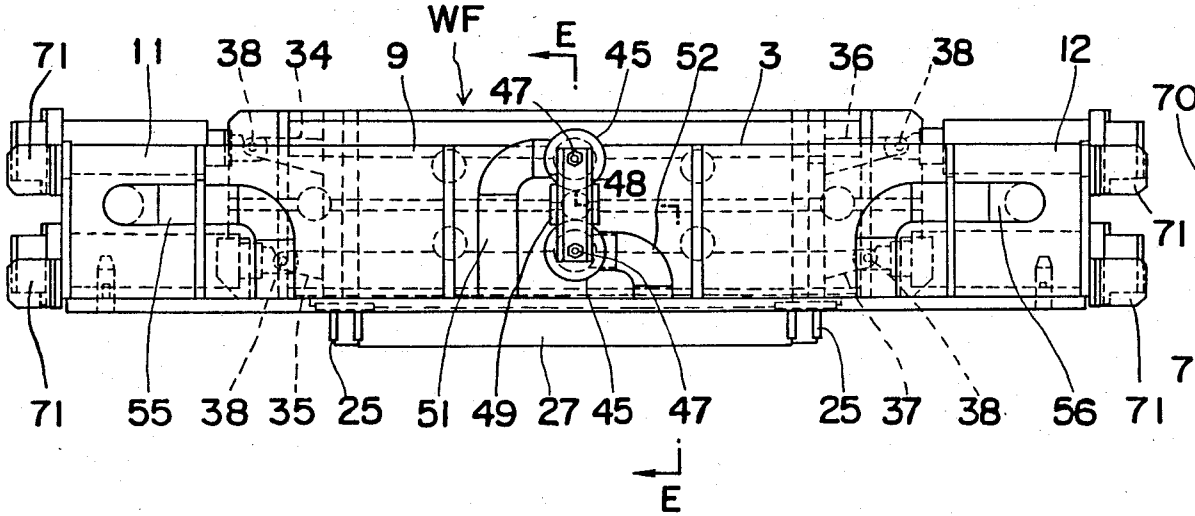
FIG. 2 is a front view of the mold assembly of FIG. 1.

As shown in FIGS. 1 to 3, foot rolls 27 extend along the longer sides of a mold opening 26 and are rotatably mounted on lower brackets 25 of the wide back-up frames 3 and 4, respectively. Further, foot rolls 29 extend along the shorter sides of the mold opening 26 and are rotatably mounted on lower brackets 28 of the narrow back-up frames 7 and 8, respectively. These foot rolls 27 and 29 are located at the lowermost positions of the mold unit MU to guide the cast strip which is withdrawn from the mold.

Figure 5:
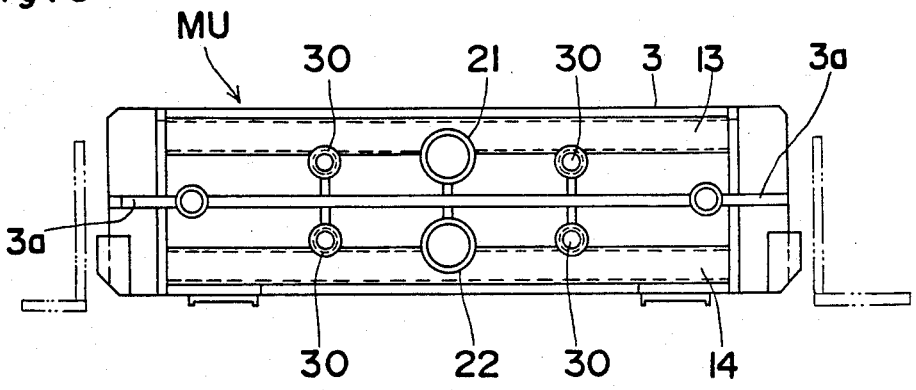
FIG. 5 is a front view of the mold unit of FIG. 4.
Figure 6:
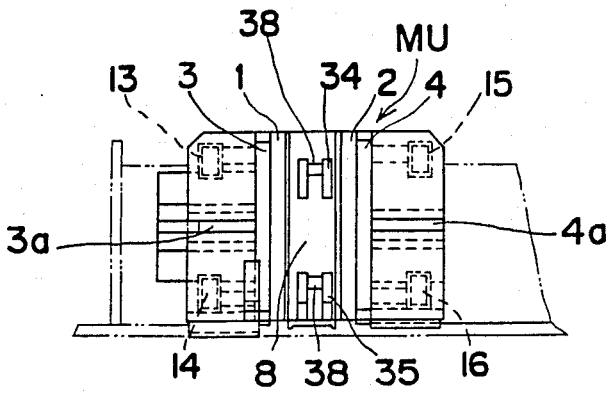
FIG. 6 is a right side view of the mold of FIG. 5.
Figure 7:
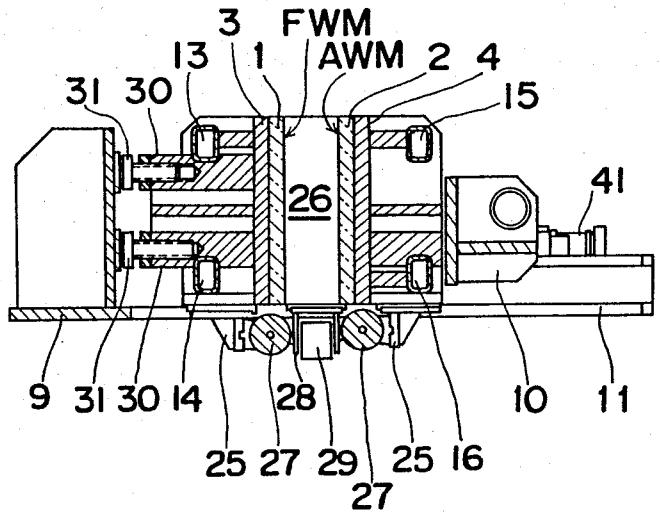
FIG. 7 is a sectional view taken along line C—C of FIG. 1.

As seen in FIGS. 4 and 5, the datum-side and adjustable-side wide back-up frames 3 and 4 of the mold unit MU are provided with flanges 3*a* or 4*a* at the respective longitudinal ends, the flanges 3*a* and 4*a* each having a mold fixing hole 3*b* or 4*b*. The mold fixing holes 4*b* in the flanges 4*a* of the adjustable-side wide back-up frame 4 are each in the form of a slot having the longer dimension in the direction of shift for adjustment of the mold configuration according to the dimensions of the slab to be cast. In order to adjust the space between the wide back-up frame 3 and the water supply frame 9 on the datum side, which determines the position of the datum-side wide mold wall FWM, adjusting screws 31 are threaded into bosses 30 which are provided at four vertically and transversely spaced positions on the back side of the water jacket of the wide back-up frame 3, facing the water supply frame 9 on the datum side as shown particularly in FIG. 7.

Figure 8:
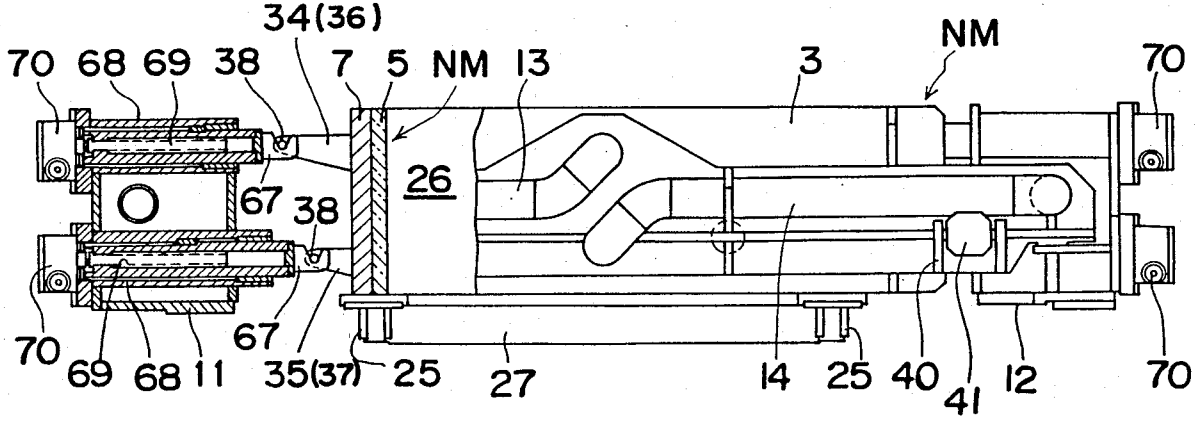
FIG. 8 is a sectional view taken along line A—A of FIG. 1.

As shown in FIG. 8, a couple of long and short brackets 34 (36) and 35 (37) are fixed in upper and lower positions on the back side of each one of the narrow mold walls NM, only one of which is shown. A hook pin 38 is fixed at the fore ends of each of these brackets.

The lower side of the water supply frame 10 is supported by the support frames 11 and 12 for movement in back and forth directions. As shown in FIG. 1, fluid-operated clamping cylinders 41 for locating and clamping the mold are mounted on brackets 40 which are fixed on the back side of the water supply frame 10 on the adjustable side in opposite end portions thereof. Piston rods 42 of the clamping cylinders 41 are connected to the support frames 11 and 12, respectively.

Accordingly, upon driving the clamping cylinders 41, the water supply frame 10 on the adjustable side drives forward the mold unit MU toward the datum side through the back-up frame 4 on the adjustable side. The water supply frame 10 on the adjustable side is retracted to an unclamped position upon releasing the clamping cylinders 41.

As seen in FIG. 12, blind-bottomed cylindrical guide sleeves 45 are fixed in upper and lower positions at the center of the water supply frame 9 on the datum side, the open ends of the guide sleeves 45 being directed toward the water feed and discharge ports 21 and 22 of the datum-side water jacket of the wide back-up frame 3. Blind-bottomed cylindrical water feed and discharge sleeves 46 are fitted in the guide sleeves 45 for back and forth movements therein employing a water-tight seal obtained by packing. The fore ends of the water feed and discharge sleeves 46 are fitted in the water feed and discharge ports 21 and 22 of the datum-side water jacket of the wide back-up frame 3 and sealed water-tight by packing. Fixed to the bottoms of the water feed and discharge sleeves 46 are shafts 47 which are projected to the outside through the ends of the respective guide sleeves 45 and connected to each other by a link plate 48 at the projected ends. Connected to the link plate 48 is a piston rod 49*a* of a fluid-operated cylinder 49, such as a hydraulic cylinder, which is fixedly mounted on the back side of the water supply frame 9 on the datum side, thereby to drive the water feed and discharge sleeves 46 simultaneously back and forth through the link plate 48 and shafts 47. Similarly, water feed and discharge sleeves 50 have respective open ends directed toward the water feed and discharge ports 23 and 24 of the water jacket of the wide back-up frame 4. They are fixed in upper and lower center positions on the back side of the water supply frame 10 on the adjustable side. The fore ends of the sleeves 50 are fitted in the water feed and discharge ports 23 and 24 of the water jacket of the wide back-up frame 4 for back and forth movement employing a water-tight seal obtained by packing. The fitting engagement of the sleeves 50 can be achieved simultaneously by the afore-mentioned clamping cylinders 41 which drive the opposite frames.

As illustrated in FIGS. 1 to 3, first and second water feed/discharge ducts 51 and 52 are in communication with water feed/discharge facilities located in center positions of the base of the water supply frame 9 on the datum side, the first water feed/discharge duct 51 being connected to the upper guide sleeve 45 and an associated water feed/discharge port 53 of the upper sleeve 46 (see FIG. 12), and the second water feed/discharge duct 52 being connected to the lower guide sleeve 45 and an associated water feed/discharge port 54 of the lower sleeve 46.

Third and fourth water feed/discharge ducts 55 and 56 are located in opposite end portions of the water supply frame 9 on the datum side, the third water feed/-discharge duct 55 being passed behind the narrow back-up frame 7 and secured at its open end 55*a* to a riser portion of support frame 11. The fourth water feed/discharge duct 56 is passed behind the other narrow back-up frame 8 and secured at its open end 56*a* to a riser portion of support frame 12.

Provided on the water supply frame 10 on the adjustable side are fifth and sixth water feed/discharge ducts 57 and 58, of which the fifth water feed/discharge duct 57 has an open end connected to a water feed/discharge sleeve 59, which is fixed to a riser portion of the water supply frame 10 on the adjustable side, in face to face relation with the end opening 55*a* of the third water feed/discharge duct 55. The opening at the other end of the fifth water feed/discharge duct 57 is connected to the upper water feed/discharge sleeve 50. One open end of the sixth water feed/discharge duct 58 is connected to a water feed/discharge sleeve 60, which is fixed to a riser portion of the water supply frame 10 on the adjustable side, in face to face relation with the open end 56*a* of the fourth water feed/discharge duct 56. The fore ends of the water feed/discharge sleeves 59 and 60 of the fifth and sixth ducts 57 and 58 are fitted in the openings 55*a* and 56*a* at ends of the third and fourth water feed/discharge ducts 55 and 56, respectively, through water-tight seals obtained by packing. Movement for causing the fitting engagement of the sleeves 59 and 60 is provided by the clamping cylinders 41.

Figure 9:
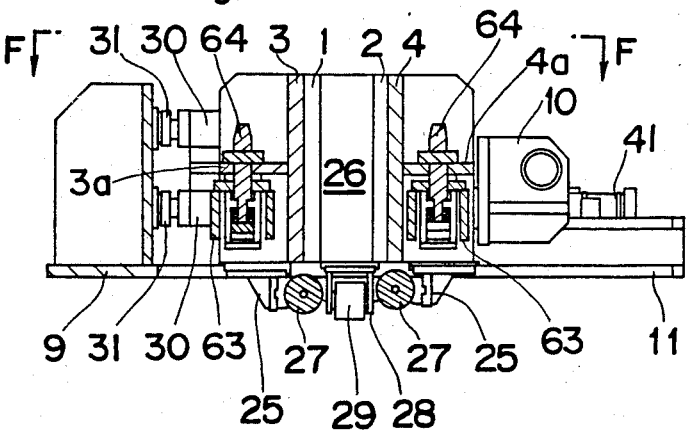
FIG. 9 is a sectional view taken along line B—B of FIG. 1.
Figure 10:
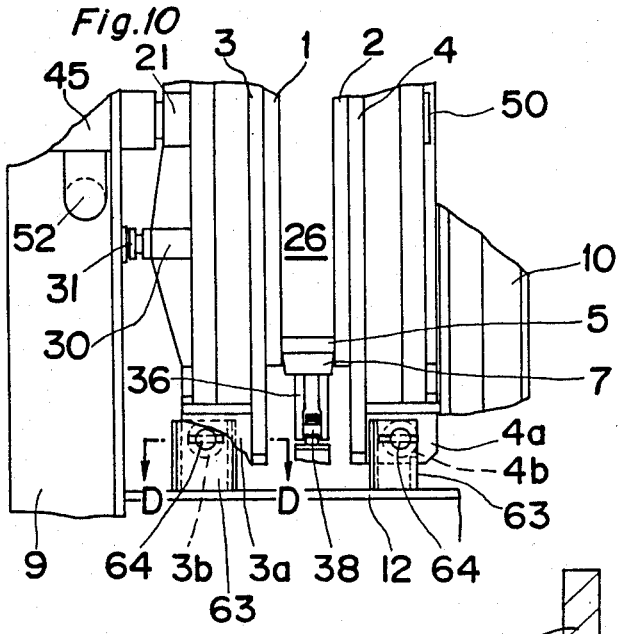
FIG. 10 is a view taken along line F—F of FIG. 9.
Figure 11:
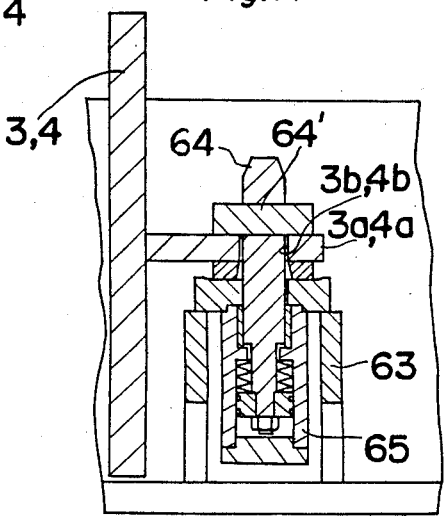
FIG. 11 is an enlarged sectional view taken along line D—D of FIG. 10.

Referring to FIGS. 9 to 11, brackets 63 are fixed on the inner sides of the support frames 11 and 12 in opposite end portions thereof, at positions beneath the flanges 3*a* and 4*a* of the wide back-up frames 3 and 4. These brackets 63 are provided with spring-loaded fixing pins 64 to be fitted in the mold fixing holes 3*b* and 4*b* of the flanges 3*a* and 4*a* from beneath. The fixing pins 64 are fitted in sleeves 65 which are supported on the brackets 63. Wedges 64' (FIG. 11), cotter pins or similar members are inserted in through holes of the fixing pins 64.

As shown in FIG. 8, mold shift means are provided, including hooks 67 in center portions on the inner sides of the support frames 11 and 12, at positions below the hook pins 38 of the narrow mold walls NM. These hooks 67 are fitted in internally threaded sleeves 68 which are fixed on the support brackets 11 and 12, for back and forth movements therein. Screw shafts 69, which are threaded into the female screws of the sleeves 68, are connected to reducers 70, which are fixedly mounted on the back sides of the frames 11 and 12, and are driven by electric motors 71, which are also fixedly mounted on the back sides of the support frames 11 and 12.

The mold unit on the continuous casting mold assembly of the above-described construction is replaced in the following manner.

When there arises a need for replacing the mold, the water supply frame 10 on the adjustable side is retracted by operation of the cylinders 41 to release the wide mold wall on the adjustable side. Thereby, the water discharge sleeve 59 of the fifth water feed/discharge duct 57 is extracted out of the opening 55*a* at one end of the third water feed/discharge duct 55, the water feed/-discharge sleeve 60 of the sixth water feed/discharge duct 56 is extracted out of the opening 56*a* at one end of the fourth water feed/discharge duct 56, and the water feed/discharge sleeves 50 of the fifth and sixth ducts 57 and 58 are extracted out of the water feed and discharge ports 23 and 24 of the water jacket of the wide back-up frame 4.

Further, the water feed/discharge sleeves 46 of the water supply frame 9 on the datum side are extracted out of the water feed and discharge ports 21 and 22 of the water jacket of the wide back-up frame 3 on the datum side by actuating the cylinder 49.

Then the wedges 64' are removed and the mold unit MU is lifted up by a crane or other suitable means, disengaging the mold fixing holes 3*a* and 4*a* from the pins 64 and lifting up the hook pins 38 away from the hooks 67.

After the mold unit MU is removed from the water supply frame WF in this manner, a fresh mold unit which has been put into an appropriate condition by off-line adjustment is lowered onto the water supply frame WF by a crane or other suitable means, engaging the fixed pins 38 of the brackets 34 to 37 of the narrow mold walls with the upper and lower hooks 67, respectively. Whenever the width of the cast strip is to be changed, the narrow mold walls are shifted in this stage by the mold shifting means to positions corresponding to the desired cast strip width. After the cast strip size is changed, the clamp cylinders 41 are actuated to press the adjustable side wide mold wall AWM completing the setting of the mold. Thus, it suffices merely to change the mold unit MU for the entire mold replacement operation. The water feed/discharge system is automatically set up by operating the clamp cylinders 41 and the cylinder 49.

The mold assembly according to the invention permits changing the width of the cast strip to a desired size during the casting operation. For this purpose, the mold shifting means is suitably operated during the casting operation to shift the narrow mold walls to the positions corresponding to the desired cast strip width.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A continuous casting mold assembly, comprising in combination:

a mold unit including first and second wide mold walls each having a wide copper plate supported on a back-up frame, and a pair of narrow mold walls each having a narrow copper plate supported on a back-up frame and opposingly gripped between said wide mold walls;

a water supply frame including a datum-side water supply frame adapted to support and determine the position of said first wide mold wall on the back side thereof, and an adjustable-side water supply frame adapted to support said second wide mold wall for movement between clamping and unclamping positions parallel relative to said first wide mold wall;

clamp means mounted on said water supply frame for clamping said second wide mold wall toward said first wide mold wall to grip said narrow mold walls securely therebetween; and narrow wall shift means mounted on said water supply frame for adjusting a spacing between said narrow mold walls.

2. The continuous casting mold assembly according to claim 1, wherein said wide mold walls each further comprise water inlet and outlet means on a back side thereof, and wherein said water inlet and outlet means are connected to water feed and discharge ports of said water supply frame when said mold unit is in a clamped state.

3. The continuous casting mold assembly according to claim 1, wherein said narrow mold walls are each provided with upper and lower supported members extending outward from the back side thereof, said upper supported members having a greater length of extension than said lower supported member.

4. The continuous casting mold assembly according to claim 1, wherein said water supply frame on the datum side is formed in a U shape.

5. The continuous casting mold assembly according to claim 1, wherein said water supply frame on the datum side further comprises guide portions at the opposite ends thereof for guiding said water supply frame on the adjustable side in the clamping and unclamping directions.

6. The continuous casting mold assembly according to claim 1, wherein said clamp means is located between opposite end portions of said datum-side water supply frame and the back side of said adjustable-side water supply frame.

7. The continuous casting mold assembly according to claim 4, wherein said narrow mold wall shift means is provided at each end of said datum-side water supply frame.

8. The continuous casting mold assembly according to claim 1, wherein said narrow mold wall shift means further comprises motor means, a reducer, at least one screw shaft to be driven from said motor means through said reducer, and at least one screw member to be fed by said screw shaft.

9. The continuous casting mold assembly according to claim 8, wherein said at least one screw shaft and said at least one screw member further comprise upper and lower screw shafts and upper and lower screw members located in upper and lower positions, and wherein said narrow mold walls are each provided with upper and lower supported members at positions corresponding to the upper and lower screw members, said upper and lower supported members having coupling portions at the fore ends thereof for engagement with coupling portions at fore ends of said screw feed members when lowered onto the latter.

* * * * *